US010242813B2

(12) United States Patent
Jia et al.

(10) Patent No.: US 10,242,813 B2
(45) Date of Patent: Mar. 26, 2019

(54) INDICATION DEVICE OF ELECTRIC SWITCH

(71) Applicants: SEARI ELECTRIC TECHNOLOGY CO., LTD., Shanghai (CN); ZHEJIANG CHINT ELECTRICS CO., LTD., Yueqing (CN)

(72) Inventors: Feng Jia, Shanghai (CN); Jiexin Zheng, Shanghai (CN); Hong Xi, Shanghai (CN); Ping Zeng, Shanghai (CN); Sihong Li, Shanghai (CN); Beiming Huang, Shanghai (CN)

(73) Assignees: SEARI ELECTRIC TECHNOLOGY CO., LTD., Shanghai (CN); ZHEJIANG CHINT ELECTRICS CO., LTD., Yueqing (CN)

( * ) Notice: Subject to any disclaimer, the term of this patent is extended or adjusted under 35 U.S.C. 154(b) by 0 days.

(21) Appl. No.: 15/740,758

(22) PCT Filed: Jun. 28, 2016

(86) PCT No.: PCT/CN2016/087417
§ 371 (c)(1),
(2) Date: Dec. 28, 2017

(87) PCT Pub. No.: WO2017/000865
PCT Pub. Date: Jan. 5, 2017

(65) Prior Publication Data

US 2018/0197694 A1 Jul. 12, 2018

(30) Foreign Application Priority Data

Jun. 30, 2015 (CN) ..... 2015 1 0373295

(51) Int. Cl.
*H01H 9/16* (2006.01)
*H01H 71/04* (2006.01)
*H01H 73/12* (2006.01)

(52) U.S. Cl.
CPC ..... *H01H 9/16* (2013.01); *H01H 71/04* (2013.01); *H01H 73/12* (2013.01)

(58) Field of Classification Search
CPC ..... H01H 9/16; H01H 71/04; H01H 73/12
See application file for complete search history.

(56) References Cited

U.S. PATENT DOCUMENTS 4,301,342 A * 11/1981 Castonguay ..... H01H 71/04 200/308
5,933,065 A 8/1999 Duchemin
(Continued)

FOREIGN PATENT DOCUMENTS

CN 1253366 A 5/2000
CN 1881493 A 12/2006
(Continued)

OTHER PUBLICATIONS

International Search Report of the International Searching Authority issued in PCT/CN2016/087417 dated Sep. 21, 2016 (8 pages).
(Continued)

*Primary Examiner* — Felix O Figueroa
(74) *Attorney, Agent, or Firm* — Osha Liang LLP

(57) ABSTRACT

An indication device of an electric switch comprises an indication component (101), a driving component (103) and a positioning component (102). The indication component (101) has at least three indication positions. Each indication position corresponds to one state of the electric switch, and the indication component (101) shows one indication mark at each indication position. The indication device of electric switch uses a single indication component (101) having at
(Continued)

least three indication positions, and the third position is provided via deformation of the indication component (101) itself, thus realizing a simple structure and low manufacturing cost.

8 Claims, 8 Drawing Sheets

(56) References Cited

U.S. PATENT DOCUMENTS

| | | | | |
|---|---|---|---|---|
| 5,981,887 | A * | 11/1999 | Robarge | H01H 71/04 200/308 |
| 6,144,002 | A * | 11/2000 | Coudert | H01H 3/30 200/400 |
| 7,186,933 | B2 * | 3/2007 | Turner | G05G 1/04 200/50.21 |
| 2002/0038759 | A1 | 4/2002 | Hamada et al. | |

FOREIGN PATENT DOCUMENTS

| | | | |
|---|---|---|---|
| CN | 101154538 | A | 4/2008 |
| CN | 101339866 | A | 1/2009 |
| CN | 201788909 | U | 4/2011 |
| CN | 103681128 | A | 3/2014 |
| CN | 203644687 | U | 6/2014 |
| EP | 1722388 | A1 | 11/2006 |

OTHER PUBLICATIONS

Written Opinion of the International Searching Authority issued in PCT/CN2016/087417 dated Sep. 21, 2016 (3 pages).

Corresponding Chinese Application No. 201510373295.1 Office Action with partial English translation of the search report dated Aug. 30, 2017 (7 pages).

* cited by examiner

INDICATION DEVICE OF ELECTRIC SWITCH

BACKGROUND OF THE INVENTION

1. Field of the Invention

The present invention relates to a field of low-voltage electric apparatus, more particularly, to an electric switch of a low-voltage electric apparatus.

2. The Related Art

An electric switch device can connect or disconnect a normal working current. An electric switch device with a protection function can break a fault current when a fault current exists in a system, so as to prevent the system from being damaged. The electric switch itself has one or more states, such as: connected, normal breaking, fault breaking, etc. As the electric switches have different states, some electric switches are provided with a state indication component, which may facilitate a user to determine a current state of the electric switch.

An indication component of electric switch according to prior art can only indicate two positions: namely a "closing" position and an "opening" position. When the electric switch works normally, it is indicated as "closing". When the electric switch is broken, whatever it is a normal breaking or a fault breaking, it is indicated as "opening". The indication component of electric switches is able to indicate a fault state, but extra fault indication components are required. The extra fault indication components and the original indication component are used in combination to indicate the state of fault breaking. Multiple indication components result in a complex combined display of the states, while the multiple indication components also make the mechanical structure be more complex, which is not good for the miniaturization, nor the manufacturing cost of the electric switch.

SUMMARY

The present invention provides an indication device of an electric switch. A plurality of states of the electric switch are indicated by a single indication component with a plurality of indication positions.

According to an embodiment of the present invention, an indication device of electric switch is provided. An indication component of the indication device is provided with at least three indication positions, each indication position corresponds to one state of the electric switch, and the indication component shows one indication mark at each indication position.

According to an embodiment, an indication component is rotatably mounted on a shell of the electric switch, the indication component is aligned with an indication hole in a panel of the electric switch, the indication component is provided with a plurality of indication marks. A driving component is mounted within the shell of the electric switch, the driving component drives the indication component to rotate to one indication position, and one of the indication marks on the indication component is aligned with the indication hole. A positioning component is mounted within the shell of the electric switch, the positioning component cooperates with the indication component, so that a particular indication mark on the indication component is aligned with the indication hole.

According to an embodiment, the indication component comprises: a body, a shaft, an indication panel, a first leg and a second leg. The body is bent and a second end of the body is forked to form a first arm and a second arm. The shaft is located in the middle of the body. The indication panel is mounted on a first end of the body, the indication marks are provided on the indication panel. One end of the indication panel is provided with a positioning pin which extends towards both sides. The first leg is mounted on the first arm at the second end of the body. The second leg is mounted on the second arm at the second end of the body.

According to an embodiment, the first arm and the second arm of the body are elastic. The first leg cooperates with the driving component. The second leg cooperates with the positioning component.

According to an embodiment, the positioning component is provided with a positioning leg which cooperates with the second leg of the indication component.

According to an embodiment, the indication component is provided with three positions: a normally-connecting position, a normally-breaking or non-short-circuit fault breaking position and a short-circuit fault breaking position. The positioning component is provided with three positions and the positioning component rotates among the three positions. The driving component is provided with two positions and the driving component moves between the two positions.

According to an embodiment, the indication panel is provided with three indication marks: an indication mark for indicating that the electric switch is normally connected, an indication mark for indicating that the electric switch is normally broken or broken due to non-short-circuit fault, and an indication mark for indicating the electric switch is broken due to short-circuit fault.

According to an embodiment, the positioning component is provided with position A, position B and position C, position C is located between position A and position B. When the positioning component is located at position C, the driving component cooperates with the first leg, the positioning leg cooperates with the second leg, the first arm and the second arm are deformed and the indication component remains at a short-circuit fault breaking position.

The indication device of electric switch according to the present invention adopts a single indication component with at least three indication positions. A third position is provided by deformation of the indication component itself, so that a simple structure and low manufacturing cost are realized.

BRIEF DESCRIPTION OF THE DRAWINGS

The above and other features, natures, and advantages of the invention will be apparent by the following description of the embodiments incorporating the drawings, wherein.

DETAILED DESCRIPTION OF EMBODIMENTS

The present invention provides an indication device of electric switch. An indication component of the indication device is provided with at least three indication positions. Each indication position corresponds to one state of the electric switch. The indication component shows one indication mark at each indication position. According to an embodiment, the indication component is provided with three positions which correspond to three states of the electric switch respectively: a normally-connecting state, a normally-breaking or non-short-circuit fault breaking state, and a short-circuit fault breaking state.

Figure 1:
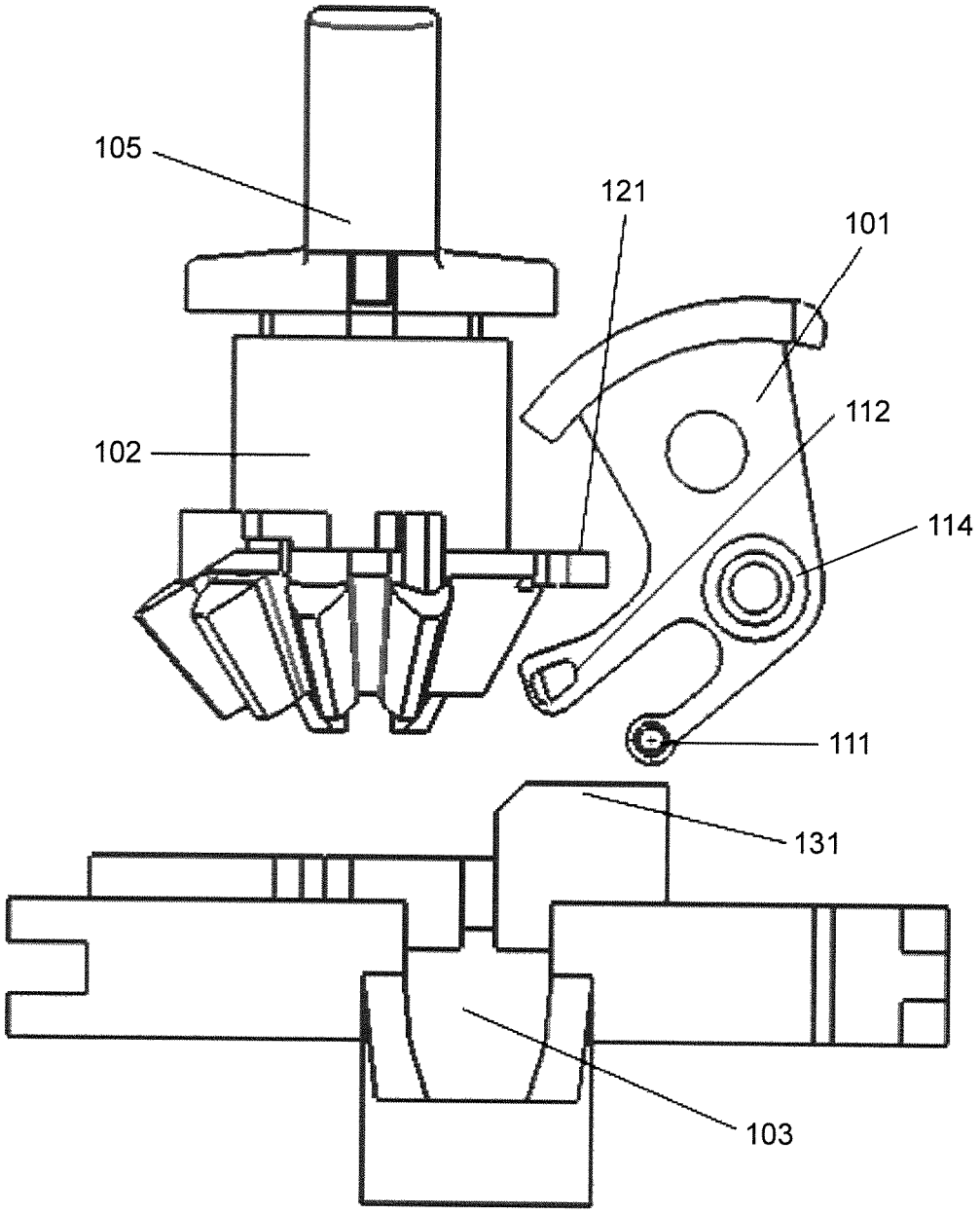
FIG. 1 illustrates a schematic structural diagram of an indication device of electric switch according to an embodiment of the present invention.
Figure 2:
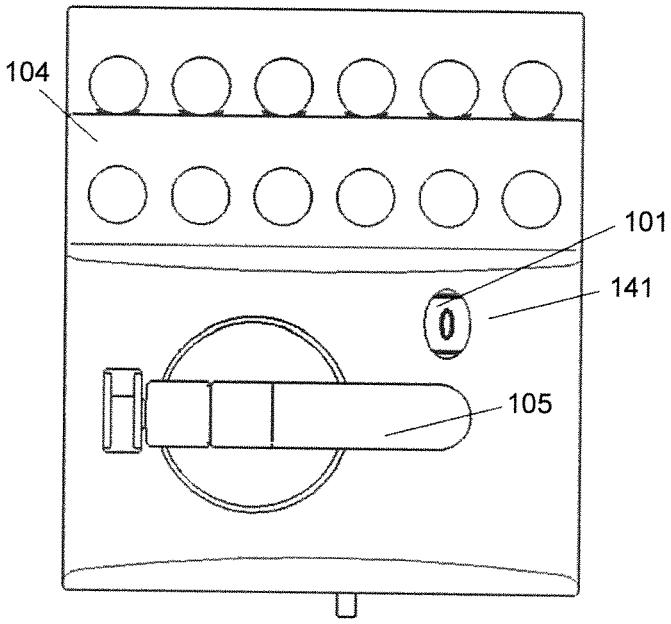
FIG. 2 illustrates a front schematic diagram of a panel using the indication device of electric switch as shown in FIG. 1.
Figure 3:
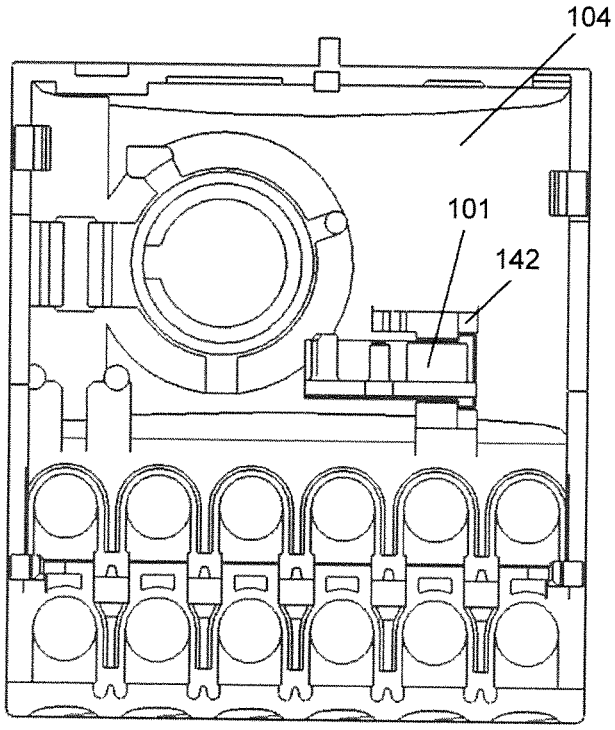
FIG. 3 illustrates a back schematic diagram of the panel using the indication device of electric switch as shown in FIG. 1.

As shown in FIG. 1, FIG. 2 and FIG. 3, a schematic structural diagram of an indication device of electric switch according to an embodiment of the present invention, and a schematic diagram of a panel using the indication device of electric switch are illustrated. The indication device of electric switch comprises an indication component 101, a driving component 103 and a positioning component 102. The indication component 101 is rotatably mounted on a shell of the electric switch. The indication component 101 is aligned with an indication hole 141 in a panel 104 of the electric switch. The indication component 101 is provided with a plurality of indication marks. The size of the indication hole 141 is matched with a single indication mark on the indication component 101, so that one indication mark on the indication component 101 can be observed through the indication hole 141 from a front perspective of the panel 141, and only one indication mark can be observed in each time. The driving component 103 is mounted within the shell of the electric switch. As shown in FIG. 1, the driving component 103 is disposed below the indication component 101. It should be noticed that, it is not necessary to dispose the driving component 103 below the indication component 101 in an actual arrangement. However, a relative position relationship among the driving component 103, the indication component 101 and the positioning component 102 shall be the same as that shown in FIG. 1. The driving component 103 drives the indication component 101 to rotate to one indication position. One of the indication marks on the indication component 101 is aligned with the indication hole 141, so as to indicate a corresponding state of the electric switch. The positioning component 102 is mounted within the shell of the electric switch. According to the illustrated embodiment, the positioning component 102 is mounted on a bottom portion of a driving handle 105. A handle portion of the driving handle 105 is above the panel 104 and the bottom portion of the driving handle 105 is beneath the panel 104. The positioning component 102 cooperates with the indication component 101, so that a particular indication mark on the indication component 101 is aligned with the indication hole 141. In other words, the positioning component 102 limits the indication component 101 at a particular indication position. The positioning component 102 is provided with a positioning leg 121, and the positioning component 102 limits a position of the indication component 101 through the positioning leg 121.

A working process of the indication component is described in detail below.

Figure 4:
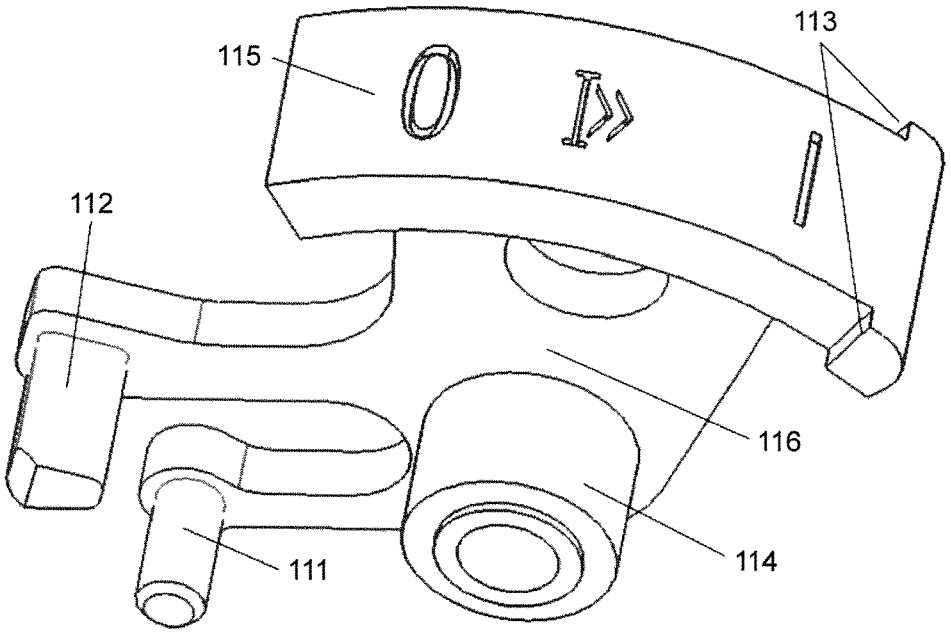
FIG. 4 illustrates a structural diagram of an indication component of the indication device of electric switch according to an embodiment of the present invention.

As shown in FIG. 4, a structural diagram of an indication component of the indication device of electric switch according to an embodiment of the present invention is illustrated. As shown in FIG. 1, the indication component 101 comprises a body 116. The body 116 is bent. A shaft 114 is provided in the middle of the body 116. An indication panel 115 is mounted on a first end of the body 116 and the indication marks are provided on the indication panel 115. According to the illustrated embodiment, the indication panel 115 is an arc-shaped plate, and three indication marks are arranged on the indication panel 115 with a certain interval: an indication mark "1" for indicating that the electric switch is normally connected, an indication mark "0" for indicating that the electric switch is normally broken or broken due to non-short-circuit fault, and an indication mark "I>>" for indicating the electric switch is broken due to short-circuit fault. One end of the indication panel 115 is provided with a positioning pin 113 which extends towards both sides. A second end of the body 116 is forked to form a first arm and a second arm. A first leg 111 is mounted on the first aim and a second leg 112 is mounted on the second arm. According to the illustrated embodiment, the first leg 111 is cylindrical and the second leg 112 is square column shaped. The first arm and the second arm are elastical and will deform when being subjected to an external force.

Figure 5A:
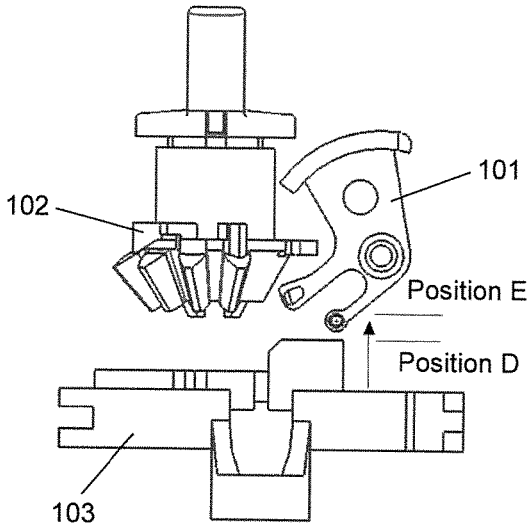
FIG. 5*a*, FIG. 5*b* and FIG. 5*c* illustrate a working process of an indication component and a driving component of the indication device of electric switch according to an embodiment of the present invention.
Figure 5B:
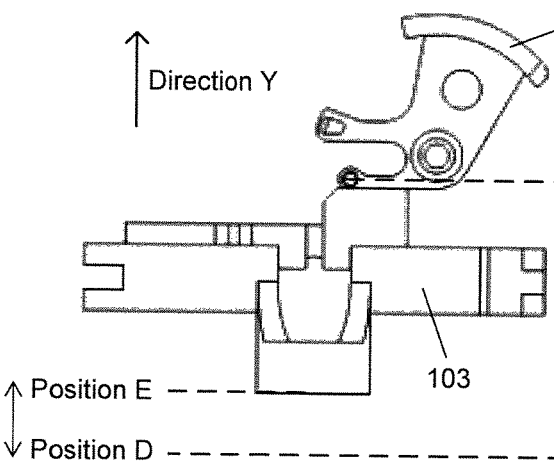
Figure 5C:
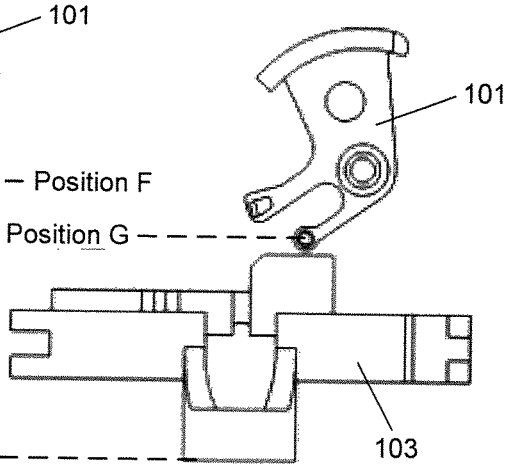

As shown in FIG. 5A, FIG. 5B and FIG. 5C, the driving component 103 moves in a reciprocation motion along direction Y. The driving component 103 pushes the first leg 111 of the indication component 101, so that the indication component 101 rotates by taking the shaft 104 as a center. As shown in FIG. 1, a driving platform 131 is provided on the driving component 103. The driving platform 131 is in contact with the first leg 111 so as to drive the first leg 111. As shown in the drawings, the driving component 103 moves between position D and position E, so as to push the first leg 111 to move between position G and position F. Correspondingly, the indication component 101 moves between a first position and a second position. Because the position of the first leg 111 is absolutely corresponding to the position of the indication component 101, in order to express convenience, position G and position F are used to refer to both the position of the first leg 111 and the position of the indication component 101. The first leg 111 drives the indication component 101 to rotate about the shaft 104. The arc-shaped indication panel 115 moves along with the rotation of the indication component 101, and different positions on the indication panel 115 will be aligned with the indication hole 141, so that different indication marks can be observed through the indication hole 141 to indicate different states of the electric switch. When the driving component 103 moves from position D to position E, the driving component 103 will apply a force to the first leg 111 and drives the indication component 101 to rotate. When the driving component 103 moves from position E to position D, the driving component 103 no longer applies the force to the first leg 111, the indication component 101 returns from position F returns to position G by a self-reset force. The self-reset force of the indication component 101 may be generated by a spring, a reset structure or gravity.

Figure 6:
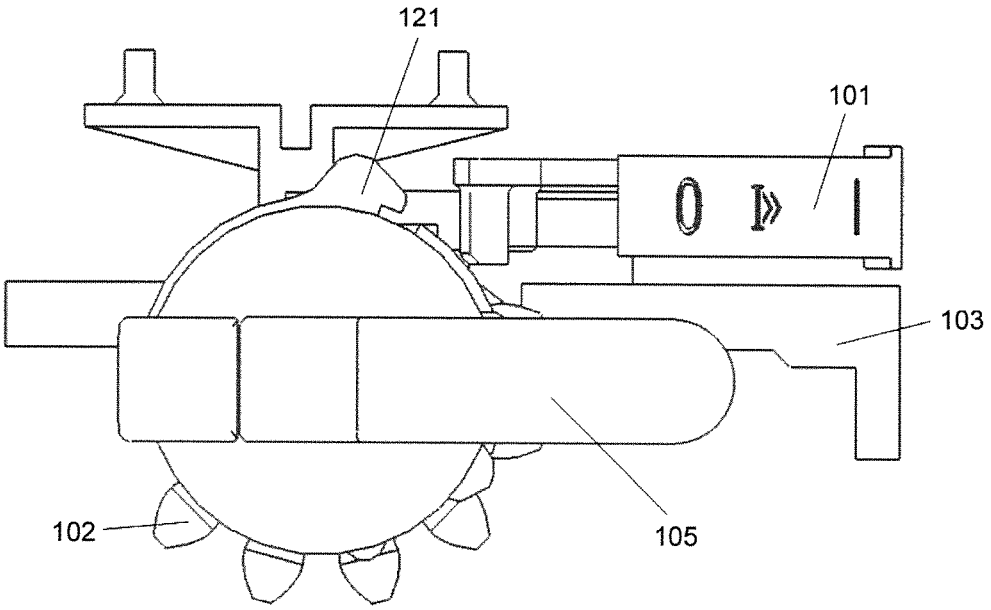
FIG. 6 illustrates a top structural diagram of the indication device of electric switch according to an embodiment of the present invention.

FIG. 6 illustrates a top structural diagram of the indication device of electric switch according to an embodiment of the present invention. As shown in FIG. 6, the positioning component 102 limits a position of the indication component 101 through the positioning leg 121. In combination with FIG. 7*a*, FIG. 7*b*, FIG. 7*c*, FIG. 8*a*, FIG. 8*b* and FIG. 8*c*, the positioning component 102 may be remained at three positions: position A, position B and position C. Position C is located between position A and position B. The positioning component 102 rotates between position A and position B.

Figure 7A:
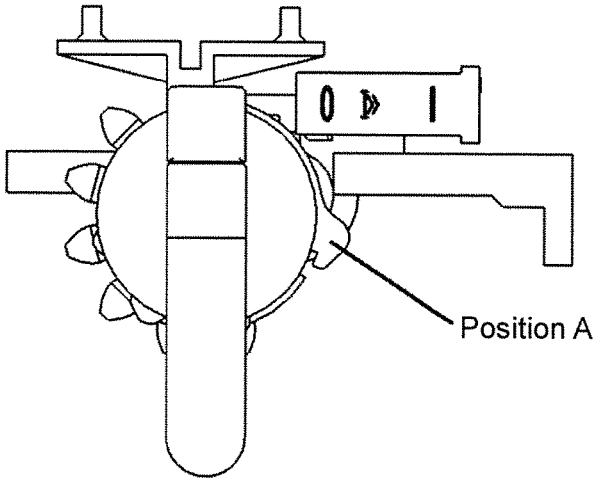
FIG. 7*a*, FIG. 7*b* and FIG. 7*c* illustrate a working process of an indication component and a positioning component of the indication device of electric switch according to an embodiment of the present invention.
Figure 8A:
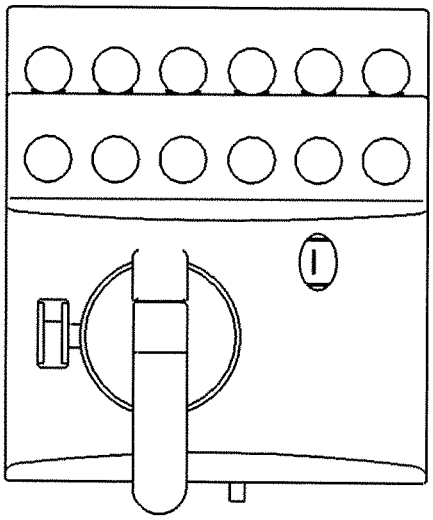
FIG. 8*a*, FIG. 8*b* and FIG. 8*c* illustrate states of the indication component which are observed through the panel according to an embodiment of the present invention.

When the electric switch is normally-connected, the components act as follows: the positioning component 102 is driven by the driving handle 105 to rotate from position B to position A, as shown in FIG. 7*a*. The driving component 103 moves from position E to position D. The driving component 103 does not apply a force to the indication component 101. The indication component 101 moves from position F to position G under the self-reset force, the first leg 111 also rotates from position F to position G. The positioning pin 113 on the indication component 101 is limited by a positioning piece 142 on the panel 104 (as shown in FIG. 3), so that the indication component 101 remains at position G. At position G, the indication mark "1" for indicating that the electric switch is normally connected is aligned with the indication hole 141 on the panel. As shown in FIG. 8*a*, the indication mark "1" is observed through the indication hole 141, indicating that the electric switch is normally connected.

Figure 7B:
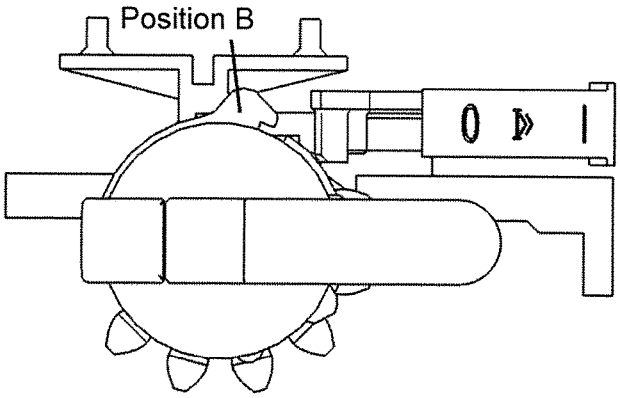
Figure 8B:
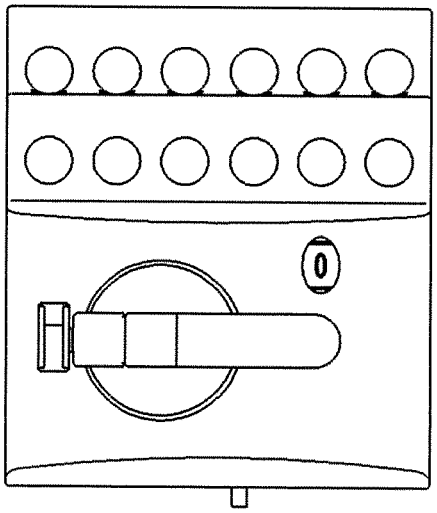

When the electric switch is normally-broken or broken due to non-short-circuit fault, the components act as follows: the positioning component 102 is driven by the driving handle 105 to rotate from position A to position B, as shown in FIG. 7*b*. The driving component 103 moves from position D to position E. The driving component 103 applies a force to the first leg 111 of the indication component 101. The indication component 101 moves from position G to position F as a result of the driving component 103 pushing the first leg 111. The indication component remains at position F. At position F, the indication mark "0" for indicating that the electric switch is normally broken or broken due to non-short-circuit fault is aligned with the indication hole 141 on the panel. As shown in FIG. 8*b*, the indication mark "0" is observed through the indication hole 141, indicating that the electric switch is normally-broken or broken due to non-short-circuit fault.

When a non-short-circuit fault occurs, the components act as follows: an electromagnet acts first, then a tripping device acts. The electromagnet acts and drives the driving component 103 to move from position D to position E, further drives the indication component 101 to move from position G to position F. The tripping device acts and the driving handle 105 drives the positioning leg 121 of the positioning component 102 to move to position B. At position B, the positioning leg 121 will not influence the action of the indication component 101.

Figure 7C:
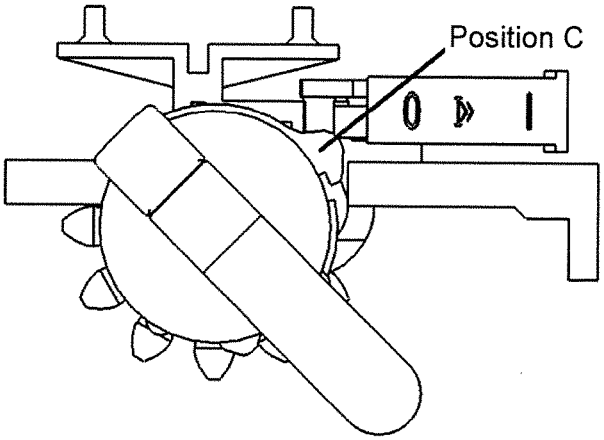
Figure 8C:
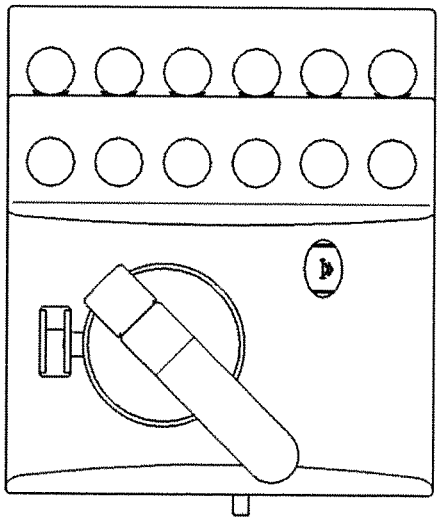
Figure 9:
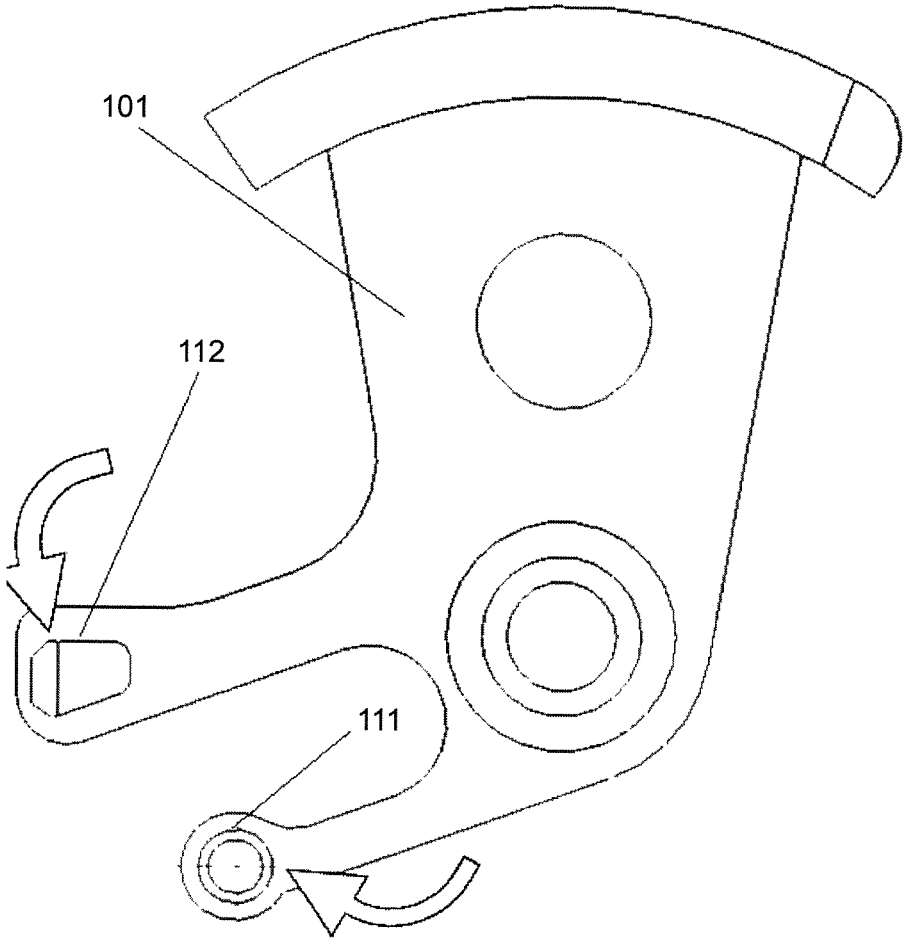
FIG. 9 illustrates a schematic diagram of deformation of the indication component of the indication device of electric switch according to an embodiment of the present invention.

When the electric switch is broken due to short-circuit fault, the components act as follows: the positioning component 102 is driven by the driving handle 105 to rotate from position A to position C, as shown in FIG. 7*c*. At position C, the positioning leg 121 of the positioning component 102 limits the second leg 112 of the indication component 101. The driving component 103 moves from position D to position E. The driving component 103 applies a force to the first leg 111 of the indication component 101. The indication component 101 moves from position G to position F as a result of the driving component 103 pushing the first leg 111. During the movement of the indication component 101, the second leg 112 is limited by the positioning leg 121, so that the indication component 101 is not able to move to position F and will remain at a position between position G and position F. The driving component 103 moves from position D to position E and remains at position E. At this time, the first leg 111 and the second leg 112 of the indication component 101 are extruded respectively. As the first arm and the second arm are elastic, the two arms are deformed when being extruded, as shown in FIG. 9. Then the indication component 101 remains at a position between position G and the position F. At the position between position G and the position F, the indication mark "I>>" for indicating the electric switch is broken due to short-circuit fault is aligned with the indication hole 141 on the panel. As shown in FIG. 8*c*, the indication mark "I>>" is observed through the indication hole 141, indicating that the electric switch is broken due to short-circuit fault.

The indication device of electric switch according to the present invention adopts a single indication component with at least three indication positions. A third position is provided by deformation of the indication component itself, so that a simple structure and low manufacturing cost are realized.

The above embodiments are provided to those skilled in the art to realize or use the invention, under the condition that various modifications or changes being made by those skilled in the art without departing the spirit and principle of the invention, the above embodiments may be modified and changed variously, therefore the protection scope of the invention is not limited by the above embodiments, rather, it should conform to the maximum scope of the innovative features mentioned in the Claims.

What is claimed is:

1. An indication device of an electric switch, the indication device comprising:

an indication component provided with at least three indication positions, each indication position corresponding to one state of the electric switch, and the indication component showing one indication mark at each indication position, wherein the indication component is rotatably mounted on a shell of the electric switch, the indication component being aligned with an indication hole in a panel of the electric switch, the indication component being provided with a plurality of indication marks showing the one indication mark at each indication position, and wherein the at least three indication positions of indication component are: a normally-connecting position, a normally-breaking or non-short-circuit fault breaking position, and a short-circuit fault breaking position;

a driving component mounted within the shell of the electric switch, the driving component driving the indication component to rotate to one of the at least three indication positions, and one of the indication marks on the indication component being aligned with the indication hole, wherein the driving component being provided with two positions and the driving component moving between the two positions; and a positioning component mounted within the shell of the electric switch, the positioning component cooperating with the indication component, so that a particular indication mark on the indication component is aligned with the indication hole, wherein the positioning component being provided with three positions and the positioning component rotating among the three positions.

2. The indication device of electric switch according to claim 1, wherein the indication component comprises:

a body, the body being bent and a second end of the body being forked to form a first arm and a second arm;

a shaft located in the middle of the body;

wherein the indication marks are provided on an indication panel mounted on a first end of the body, one end of the indication panel being provided with a positioning pin which extends towards both sides;

a first leg mounted on the first arm at the second end of the body; and a second leg mounted on the second arm at the second end of the body.

3. The indication device of electric switch according to claim 2, wherein the first arm and the second arm of the body being elastic;

the first leg cooperating with the driving component;

the second leg cooperating with the positioning component.

4. The indication device of electric switch according to claim 3, wherein the positioning component being provided with a positioning leg which cooperates with the second leg of the indication component.

5. The indication device of electric switch according to claim 4, wherein the indication panel being provided with three indication marks: an indication mark for indicating that the electric switch is normally connected, an indication mark for indicating that the electric switch is normally broken or broken due to non-short-circuit fault, and an indication mark for indicating the electric switch is broken due to short-circuit fault.

6. The indication device of electric switch according to claim 5, wherein the positioning component being provided with position A, position B and position C, wherein position C is located between position A and position B, when the positioning component is located at position C, the driving component cooperates with the first leg, the positioning leg cooperates with the second leg, the first arm and the second arm are deformed and the indication component remains at the short-circuit fault breaking position.

7. An indication device of an electric switch, the indication device comprising:

an indication component provided with at least three indication positions, each indication position corresponding to one state of the electric switch, and the indication component showing one indication mark at each indication position, wherein the indication component is rotatably mounted on a shell of the electric switch, the indication component being aligned with an indication hole in a panel of the electric switch, the indication component being provided with a plurality of indication marks showing the one indication mark at each indication position, wherein the indication component comprises:

a body, the body being bent and a second end of the body being forked to form a first arm and a second arm, the first arm and the second arm of the body being elastic, a shaft located in the middle of the body, an indication panel mounted on a first end of the body, the indication marks being provided on the indication panel, one end of the indication panel being provided with a positioning pin which extends towards both sides, a first leg mounted on the first arm at the second end of the body, and a second leg mounted on the second arm at the second end of the body;

a driving component mounted within the shell of the electric switch, the driving component driving the indication component to rotate to one indication position, and one of the indication marks on the indication component being aligned with the indication hole; and a positioning component mounted within the shell of the electric switch, the positioning component cooperating with the indication component, so that a particular indication mark on the indication component is aligned with the indication hole, wherein the first leg cooperating with the driving component, and wherein the second leg cooperating with the positioning component.

8. An indication device of an electric switch, the indication device comprising:

an indication component provided with at least three indication positions, each indication position corresponding to one state of the electric switch, and the indication component showing one indication mark at each indication position, wherein the indication component is rotatably mounted on a shell of the electric switch, the indication component being aligned with an indication hole in a panel of the electric switch, the indication component being provided with a plurality of indication marks showing the one indication mark at each indication position, wherein the indication component comprises:

a body, the body being bent and a second end of the body being forked to form a first arm and a second arm, the first arm and the second arm of the body being elastic, a shaft located in the middle of the body, an indication panel mounted on a first end of the body, the indication marks being provided on the indication panel, one end of the indication panel being provided with a positioning pin which extends towards both sides, a first leg mounted on the first arm at the second end of the body, and a second leg mounted on the second arm at the second end of the body, wherein the at least three indication positions of the indication component are: a normally-connecting position, a normally-breaking or non-short-circuit fault breaking position, and a short-circuit fault breaking position;

a driving component mounted within the shell of the electric switch, the driving component driving the indication component to rotate to one indication position, and one of the indication marks on the indication component being aligned with the indication hole;

wherein the driving component being provided with two positions and the driving component moving between the two positions, and a positioning component mounted within the shell of the electric switch, the positioning component cooperating with the indication component, so that a particular indication mark on the indication component is aligned with the indication hole, wherein the positioning component being provided with three positions and the positioning component rotating among the three positions, wherein the first leg cooperating with the driving component, wherein the second leg cooperating with the positioning component, wherein the positioning component being provided with a positioning leg which cooperates with the second leg of the indication component, wherein the indication panel being provided with three indication marks: an indication mark for indicating that the electric switch is normally connected, an indication mark for indicating that the electric switch is normally broken or broken due to non-short-circuit fault, and an indication mark for indicating the electric switch is broken due to short-circuit fault, and wherein the positioning component being provided with position A, position B and position C, wherein position C is located between position A and position B, when the positioning component is located at position C, the driving component cooperates with the first leg, the positioning leg cooperates with the second leg, the first arm and the second arm are deformed and the indication component remains at the short-circuit fault breaking position.

* * * * *